US005318135A

United States Patent [19]

Kayes

[11] Patent Number: 5,318,135

[45] Date of Patent: Jun. 7, 1994

[54] SOIL DISPLACEMENT HAMMER WITH REVERSING MECHANISM

[76] Inventor: Allan G. Kayes, Elwin Boyce's Hill, Newington, Sittingbourne, Kent, ME9 7JF, United Kingdom

[21] Appl. No.: 952,512

[22] PCT Filed: Jun. 5, 1991

[86] PCT No.: PCT/GB1/000897

§ 371 Date: Dec. 3, 1992

§ 102(e) Date: Dec. 3, 1992

[87] PCT Pub. No.: WO91/19073

PCT Pub. Date: Dec. 12, 1991

[30] Foreign Application Priority Data

Jun. 6, 1990 [GB] United Kingdom ..... 9012639

[51] Int. Cl.[5] ..... E21B 4/00

[52] U.S. Cl. ..... 175/19

[58] Field of Search ..... 175/19-23

[56] References Cited

U.S. PATENT DOCUMENTS 4,938,297 7/1990 Schmidt ..... 175/19

5,025,868 6/1991 Wentworth et al. ..... 175/19 X

*Primary Examiner*—Thuy M. Bui

*Attorney, Agent, or Firm*—Darby & Darby

[57] ABSTRACT

A pneumatically operated impact-action self-propelled mechanism for driving holes in the earth comprises a cylindrical housing assembly with an anvil at its forward end. An impact piston is provided which is reciprocal in the housing to deliver successive impacts to the anvil. The piston and housing form a forward chamber of variable volume. The mechanism further includes a control assembly comprising a forwardly extending sleeve which slides within a rear space of the impact piston to form a rear chamber of variable volume, and a central passage within the sleeve for continuous supply of compressed air through a forward opening of the sleeve into the rear chamber and therefrom into the forward chamber through a port in a side wall of the rear chamber of the impact piston. The sleeve has an aperture in its side near the forward opening and is provided with a valve operable by twisting of the sleeve. Operation of the valve controls forward and reverse movement of the mechanism. The sleeve has a circular collar which rotationally slides inside a surrounding circumferential bush and enables the sleeve to be located with the aperture open or closed by the valve.

2 Claims, 3 Drawing Sheets

SOIL DISPLACEMENT HAMMER WITH REVERSING MECHANISM

This invention relates to a soil displacement hammer with an improved reversing mechanism.

Soil displacement hammers, commonly referred to as "moles", are pneumatically operated, impact-action self-propelled mechanisms for driving holes in the ground. They can be used to install pipes, cables or conduits in the ground without the necessity for excavating a continuous trench.

GB-A-2,134,152 discloses a mole having a reversing mechanism. This mole comprises a cylindrical housing with an anvil member located at the forward end thereof. An impact piston is reciprocal in the housing to deliver successive impacts to the anvil member and forms with the housing a forward chamber cf variable volume. A control assembly comprises a forwardly extending sleeve which is slidably received within a rear space of the impact piston to form a rear chamber of variable volume. A central passage is connected to the sleeve for continuous supply of compressed air into the rear chamber and therefrom into the forward chamber through apertures in a side wall of the rear chamber of the impact piston. Means are provided for lockably locating the sleeve longitudinally with respect to the apertures for providing forward and reverse movement of the mechanism. These means include a pin which is engaged in a Z-shaped slot, and a helical spring which generally urges the control assembly into a forward position within the impact piston. This provides for normal forward movement of the mole. To provide reverse movement, the pin and slot mechanism enables the control assembly to be locked in a rearward location within the impact piston.

Another type of reversing mechanism for a mole is disclosed in GB-A-2,147,035. This is generally similar to the previous disclosure except that, instead of the pin and slot mechanism, the sleeve extending within the impact piston is movable to forward or rearward positions by means of screw threads on a rear extension thereof, which engage with corresponding screw threads of a locating member, whereby rotation of the sleeve causes longitudinal movement thereof.

An object of the present invention is to provide a simplified reversing mechanism for a mole which is more reliable in operation than the use of screw threads or pull/push (spring) methods as outlined above.

The present invention provides a pneumatically operated impact-action self-propelled mechanism for driving holes in the earth, comprising a cylindrical housing assembly with an anvil member located at a forward end thereof; an impact piston reciprocal in the housing to deliver successive impacts to the anvil member and forming with the housing a forward chamber of variable volume; and a control assembly comprising a forwardly extending sleeve which is slidably received within a rear space of said impact piston to form a rear chamber of variable volume, and a central passage within said sleeve for continuous supply of compressed air through a forward opening of the sleeve into said rear chamber and therefrom into said forward chamber through a port in a side wall of the rear chamber of said impact piston, characterised in that the sleeve has at least one aperture in its side near the forward opening and provided with valve means operable by twisting of the sleeve or a part thereof about its longitudinal axis, whereby when the aperture is closed by the valve means the compressed air is passed directly into the rear chamber for forward movement of the mechanism, and when the aperture is open compressed air can pass directly through said aperture and through said port into the forward chamber for reverse movement of the mechanism, and further characterised in that the sleeve has a circular collar remote from its forward opening and rotationally slidable inside a surrounding circumferential bush to define thereby two relatively sliding surfaces, one of said surfaces having one or more resilient protrusions adapted to locate temporarily in corresponding indentations in the other surface, whereby the sleeve can be located with the aperture open or closed by the valve means.

In a preferred embodiment of the invention, the mechanism is characterised in that the sleeve comprises an inner tube and an outer tube concentrically arranged in contact with each other and rotatable relative to each other around their common longitudinal axis, at least one aperture in the side of each tube near the forward opening of the sleeve such that the respective apertures may be placed in or out of register with each other by relative rotation of the tubes, whereby when the apertures are out of register they are blocked by the adjoining tube and the compressed air is passed directly into the rear chamber for forward movement of the mechanism, and when the apertures are in register compressed air can pass directly through said apertures and through said port into the forward chamber for reverse movement of the mechanism, and further characterised in that one of said tubes has a circular collar remote from the forward opening of the sleeve and slidably rotatable within a surrounding circumferential bush to define two relatively sliding surfaces, one of said surfaces having one or more resilient protrusions adapted to locate temporarily in corresponding indentations in the other surface, whereby the inner and outer tubes can be located with the apertures in or out of register with each other.

Reference is now made to the accompanying drawings, in which.

Figure 1:
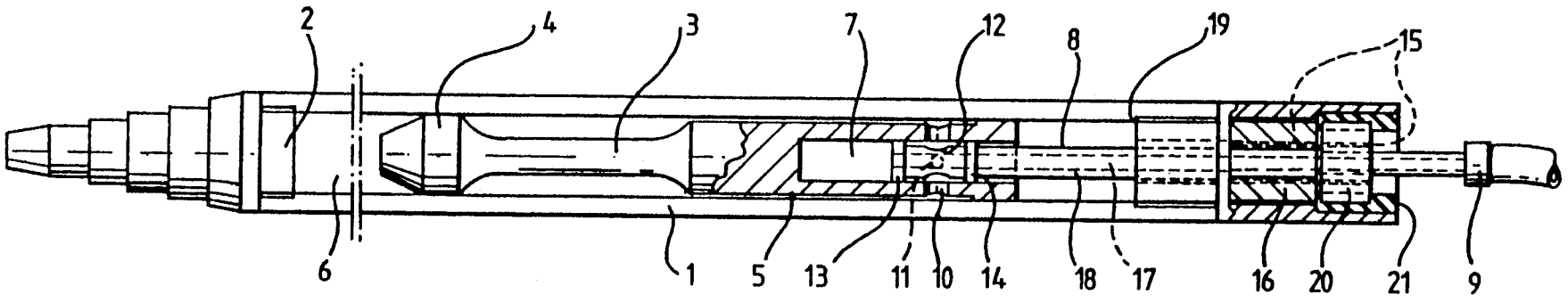
FIG. 1 is a longitudinal part-sectional view of a mole according to a preferred embodiment of the invention.

The mechanism comprises a cylindrical housing 1 having an anvil 2 located internally at the forward end. An impact piston 3 is reciprocal inside the housing, engaging the internal cylindrical wall of the housing with an interrupted annular shoulder 4 and a continuous annular shoulder 5. The space between the internal wall of the housing and the external surface of the impact piston constitutes a front working chamber 6.

The rear portion of the impact piston 3 has formed therein a cavity 7 which receives a forwardly extending sleeve 8, which is connected to a compressed air supply connector 9. The cavity 7 constitutes the rear working chamber of the mechanism, responsible for forward displacement of the impact piston 3 as described below. Ports 10 are formed through the cylindrical wall of the impact piston 3 in the area of the rear cavity 7, these ports 4 establishing communication between chambers 6 and 7.

Close to the front end of the sleeve 8 there are apertures Il and 12, which are shown closed in FIGS. 1 and 2, and the purpose of which will be described below These apertures are between a front annular ring 13 and a rear annular ring 14 on the sleeve 8, the annular rings being in sliding contact with the internal bore of the cavity 7. The piston 3 reciprocates in the longitudinal direction, but the sleeve 8 does not move longitudinally.

Figure 2:
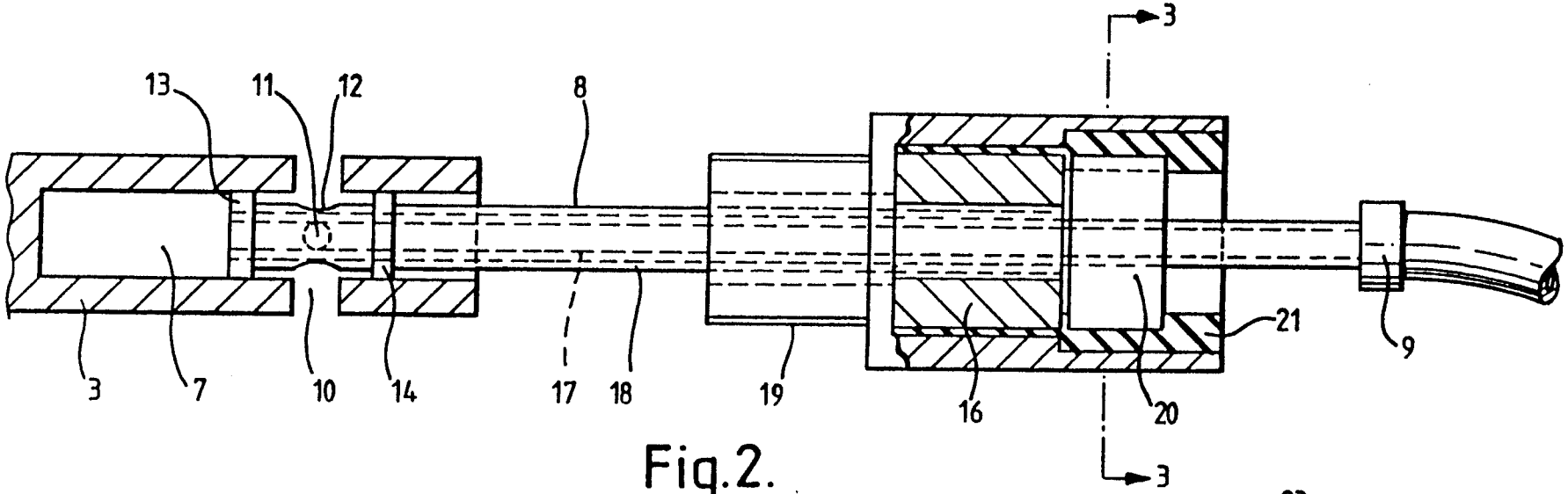
FIG. 2 is a partial longitudinal sectional view on an enlarged scale of the control assembly for the mole shown in FIG. 1.

In operation of the mechanism, with the sleeve 8 in the position as shown in FIG. 1, compressed air is fed through the sleeve 8, via its front opening into the rear working chamber 7. This causes the impact piston 3 to be driven forwardly to engage the anvil 2. The resulting impact causes the housing 1 to be driven forwardly.

At a preset point, immediately preceding the point at which the impact piston 3 strikes the anvil 2 (this preset point being defined by the position of the ports 10 in the piston 3 and by the arrangement of the head portion of the sleeve 8), the ports 10 establish communication between the chambers 6 and 7. This occurs when the ports 10 have travelled past the front annular ring 13. The front working chamber 6 then becomes connected with the source of compressed air via the rear working chamber 7, the sleeve 8 and the air supply connector 9.

The rebound of the impact piston 3 after an impact together with the force exerted by compressed air on the front face of the impact piston, owing to the difference between the working (effective) areas of the impact piston in the chambers 6 and 7 respectively, are responsible for the return stroke of the impact piston after it has delivered the impact upon the anvil 2.

In the course of this return stroke, the ports 10 become closed by the external cylindrical wall of the head portion of the sleeve 8 (i.e. when the ports 10 have moved to the rear of the front annular ring 13). During the rest of the return stroke, the compressed air in the front working chamber 6 is expanding. Towards the end of its return stroke, the motion of the impact piston 3 meets the resistance of the compressed air in the rear working chamber 7, which is continuously connected with the source of compressed air 9. At the end of the return stroke of the impact piston, the ports 10 pass beyond the rear annular ring 14 of the sleeve 8 and thus establish communication between the front working chamber 6 and the ambient atmosphere through exhaust passages 15 in a rear sleeve-supporting member 16. The above-described operating cycle then repeats itself.

The above cycle of operations is essentially the same as in GB-A-2 134 152 and 2 147 035.

Figure 4:
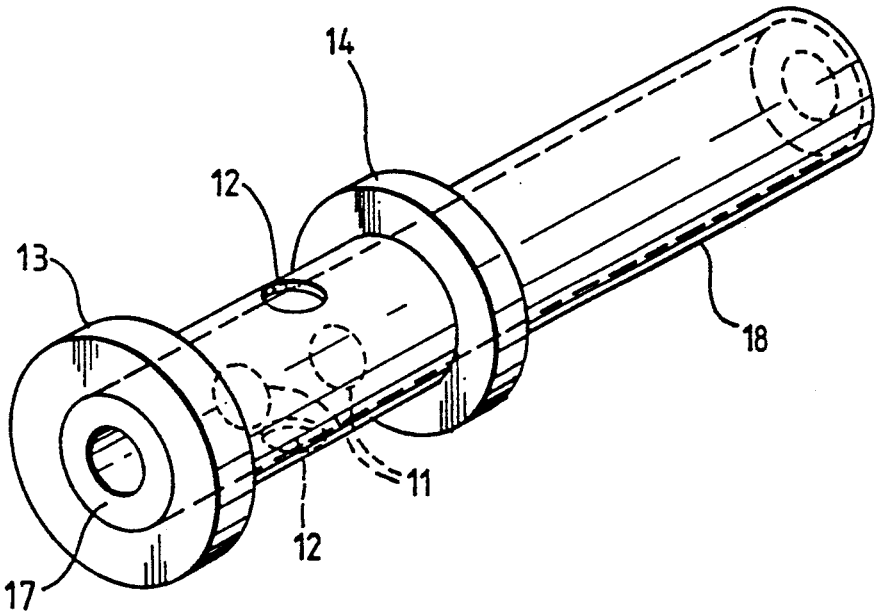
FIG. 4 is a partial perspective view of the forward part of the sleeve used in the control assembly.

In order to provide reverse movement of the mole according to the stated prior art, the sleeve 8 has to be moved rearwardly, so that its front opening is in immediate communication with the ports 10. According to the described embodiment of the present invention, this need for rearward movement of the sleeve is avoided as follows. The sleeve comprises an inner tube 17 and an outer tube 18 concentrically arranged and in rotational sliding contact with each other. The outer tube 18 has a pair of diametrically opposed apertures 12 in its wall a short distance to the rear of the front opening. The inner tube 17 has a similar pair of diametrically opposed apertures 11 the same distance to the rear of the front opening. In the position shown in FIGS. 1, 2 and 4, the apertures 11 and 12 are out of register with each other, i.e. they are separated by a quarter turn, and each aperture is therefore blocked by the adjacent wall of the inner or outer tube, respectively. When the apertures are blocked as shown, forward motion of the mole is achieved as described above.

In order to provide rearward motion of the mole, the inner tube 17 is rotated through a quarter turn until the apertures 11 and 12 are in register with each other. Compressed air from the supply hose 5 then passes directly through the apertures 11 , 12 and the ports 10 into the forward chamber 6, as well as the rear chamber 7, and this provides rear movement of the mole.

When the apertures 11 and 12 are in register with each other, the compressed air is fed through the apertures thereby causing the piston 3 to move rearwardly, as most of the air pressure is now on the outside of the piston. The piston moves rearwardly until it impacts on a rear nut 19 which is just forward of the sleeve support member 16. The mole is thereby moved rearwardly through the ground. When the ports 10 pass to the rear of the rear annular ring 14, the compressed air passes entirely into the rear working chamber 7, causing the piston 3 to move forward again, until the ports 10 are between the front and rear annular rings 13 and 14. This cycle is then continued.

Figure 3:
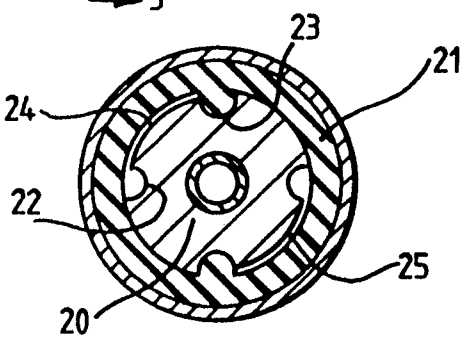
FIG. 3 is a transverse section on the line 3—3 of FIG. 2.

The inner tube 17 of the sleeve 8 is provided towards its rear end with a circular collar 20. The collar 20 slidably rotates within a bush 21 of resilient material, such as rubber or elastomerical plastics material. The collar 20 has four equally spaced longitudinally extending, scalloped indentations 22. The bush 21 has two diametrically opposed, longitudinal protrusions 23, which have a corresponding shape in section to the indentations 22. Cooperation between the protrusions 23 and indentations 22 enables the inner tube 17 to be locked in two possible rotational positions relative to the outer tube 18, in one position the apertures 11 and 12 being in register with each other, and in the other position the apertures 11 and 12 being out of register. The inner tube can be rotated between these positions by deformation of the resilient protrusions 23. Movement between these positions can be further facilitated by providing a relieved area between the respective indentations 22, as shown in FIG. 3 at 24 and 25.

The deformable bush can be fixed in position for example by gluing. However, it is preferably moulded in situ, for example by injection moulding.

In a simulated operational test of the control assembly described above, 15,000 changes of position of the collar within the bush were recorded, after which there was little sign of wear and no loss of locking ability. This test is equivalent to about 5 years operation with maximum possible usage.

The skilled person will appreciate that modifications can be made to the embodiments described above while retaining the basic principles of the invention. With regard to the locating means, the protrusions and indentations can be on either of the respectively sliding surfaces, or indeed there can be a mixture of protrusions and indentations on each surface. In the embodiments described, the inner tube of the sleeve is rotatable, and the outer tube is fixed. However, exactly the same effect could be achieved by making the outer tube rotatable, with the inner tube fixed.

The mutually rotatable inner and outer tubes described above, with their respective apertures, in effect constitute a valve means for opening and closing the apertures by means of rotation of one of the tubes which constitutes part of the sleeve. Exactly the same effect could be achieved by substituting any other suitable valve means to open and close apertures towards the front of the sleeve by means of rotating at least part of the sleeve.

I claim:

1. A pneumatically operated impact-action self-propelled mechanism for driving holes in the earth, comprising a cylindrical housing assembly with an avil member located at a forward end thereof; an impact piston reciprocal in the housing to deliver successive impacts to the anvil member and forming with the housing a forward chamber of variable volume; a control assembly comprising a forwardly extending sleeve which is slidably received within a rear space of said impact piston to form a rear chamber of variable volume, and a central passage within said sleeve for continuous supply of compressed air through a forward opening of the sleeve into said rear chamber and therefrom into said forward chamber through a port in a side wall of the rear chamber of said impact piston, the sleeve having at least one aperture in its side near the forward opening and provided with valve means operable by twisting of the sleeve or a part thereof about its longitudinal axis, whereby when the aperture is closed by the valve means the compressed air is passed directly into the rear chamber for forward movement of the mechanism, and when the aperture is open compressed air can pass directly through said aperture and through said port into the forward chamber for reverse movement of the mechanism, and means for locating the sleeve with the aperture open or closed by the valve means, characterised in that the sleeve has a circular collar remote from its forward opening and rotationally slidable inside a concentrically surrounding circumferential bush to define thereby two relatively sliding surfaces which continually bear on each other radially, one of said surfaces having one or more protrusions which are adapted to resiliently locate temporarily in corresponding indentations in the other surface.

2. A mechanism according to claim 1, in which the sleeve comprises an inner tube and an outer tube concentrically arranged in contact with each other and rotatable relative to each other around their common longitudinal axis, at least one aperture in the side of each tube near the forward opening of the sleeve such that the respective apertures may be placed in or out of register with each other by relative rotation of the tubes, whereby when the apertures are out of register they are blocked by the adjoining tube and the compressed air is passed directly into the rear chamber for forward movement of the mechanism, and when the apertures are in register compressed air can pass directly through said apertures and through said port into the forward chamber for reverse movement of the mechanism, and in which the circular collar is mounted on the inner tube or the outer tube remote from the forward opening of the sleeve, whereby the inner and outer tubes can be located with the apertures in or out of register with each other.

* * * * *